US006091391A

United States Patent [19]

Ling et al.

[11] Patent Number: 6,091,391

[45] Date of Patent: Jul. 18, 2000

[54] CIRCUIT FOR PRODUCING A CONTRAST VOLTAGE SIGNAL FOR A LIQUID CRYSTAL DISPLAY WHICH USES A DIFFERENTIAL COMPARATOR, CAPACITORS, TRANSMISSION GATES AND FEEDBACK TO REDUCE QUIESCENT CURRENT

[75] Inventors: Lawrence Hok Sun Ling, Fanling; Leonard Hon Yan Leung, Homantin, both of The Hong Kong Special Administrative Region of the People's Republic of China

[73] Assignee: Motorola, Inc., Schaumburg, Ill.

[21] Appl. No.: 09/044,776

[22] Filed: Mar. 20, 1998

[51] Int. Cl.[7] ..... G09G 3/36; G09G 5/00

[52] U.S. Cl. ..... 345/98; 345/211

[58] Field of Search ..... 345/87, 89, 204, 345/211, 212, 213, 214, 98, 92, 147, 90; 455/574; 348/678; 713/300, 320, 321, 323; 327/52, 108, 111, 112, 50, 53, 54, 55, 56, 57

[56] References Cited

U.S. PATENT DOCUMENTS 5,352,937 10/1994 Dingwall ..... 327/52
5,459,483 10/1995 Edwards ..... 345/98
5,500,615 3/1996 Barter ..... 327/111
5,504,444 4/1996 Neugebauer ..... 327/108
5,569,965 10/1996 Tsunehiro ..... 455/574
5,696,459 12/1997 Neugebauer et al. ..... 327/108
5,712,652 1/1998 Sato et al. ..... 345/90
5,721,563 2/1998 Memida ..... 345/98
5,739,803 4/1998 Neugebauer ..... 345/98
5,825,228 10/1998 Gross ..... 327/112
5,835,999 11/1998 Grosspietsch et al. ..... 327/112
5,859,632 1/1999 Ito ..... 345/211
5,977,940 11/1999 Akiyama et al. ..... 345/92

*Primary Examiner*—Steven J. Saras
*Assistant Examiner*—Paul A. Bell

[57] ABSTRACT

A circuit (100) for produces an LCD contrast voltage signal (VLCD) for a low power MCU-controlled application. The reference voltage (VREF) for a switched mode power supply circuit (210) is supplied by a circuit comprising: logic control circuitry (110) for receiving MCU commands, a counter (120), a digital-to-analog converter (130), and a transmission gates (140, 150) and capacitors (160, 180) for generating the SMPS reference voltage (VREF), and a comparator to set off a recharge cycle whenever the capacitors' voltage difference is more than a pre-set offset voltage. This circuit has lower quiescent power consumption since, in idle cycle, only the comparator (200) consumes quiescent current which can be less than 1 $\mu$A.

6 Claims, 1 Drawing Sheet

CIRCUIT FOR PRODUCING A CONTRAST VOLTAGE SIGNAL FOR A LIQUID CRYSTAL DISPLAY WHICH USES A DIFFERENTIAL COMPARATOR, CAPACITORS, TRANSMISSION GATES AND FEEDBACK TO REDUCE QUIESCENT CURRENT

FIELD OF THE INVENTION

This invention relates to a circuit for producing a contrast voltage signal for a liquid crystal display (LCD), and particularly, though not exclusively, to such a circuit for control by a microcontroller unit (MCU) and consuming low power.

BACKGROUND OF THE INVENTION

In a battery operated product with Liquid Crystal Display (LCD), such as in an electronic pager, a switching-mode power supply (SMPS) is typically employed to produce the LCD contrast voltage (VLCD).

In such a conventional system, VLCD is adjusted by varying a mechanical potentiometer on a contrast voltage feedback connection via a feedback voltage (VFB) input to SMPS. This potentiometer is usually a variable resistor external to SMPS. Alternatively, the LCD contrast voltage can be controlled by varying a reference voltage (VREF) regulated by a pulse width modulated (PWM) signal from the MCU. With the feedback voltage, the SMPS is operated in close-loop mode to generate a base drive voltage for the SMPS which regulates the output to the VLCD. In both such known methods, VLCD is not digitally controlled.

In order to provide a fully digitally controlled LCD contrast voltage, as used in a prior art, a system with a logic control circuit, a counter and a digital-to-analog converter (DAC) have been used. Clock control signals from the MCU are applied to the logic control circuit for generating control signals to the counter. The counter outputs count values to the current-output DAC which also receives a reference voltage from an external reference voltage generator. The output current generated from the DAC draws current and produces a voltage (IR) drop across an external resistor on the VLCD feedback path to SMPS. Operated in closed-loop mode, the SMPS produce a digitally controlled LCD contrast voltage.

However, the quiescent current consumed by the DAC and the reference voltage block is relatively high (in the range of tenths to hundreds of micro-Amperes). It is an object of this invention to provide a circuit for producing a contrast voltage signal for a liquid crystal display in which power consumption may be reduced.

BRIEF SUMMARY OF THE INVENTION

In accordance with the present invention there is provided a circuit for producing a contrast voltage signal for a liquid crystal display as claimed in claim 1.

BRIEF DESCRIPTION OF THE DRAWINGS

One embodiment of the invention will now be more fully described, by way of example only, with reference to the accompanying drawings, in which.

DETAILED DESCRIPTION OF THE DRAWINGS

Figure 1:
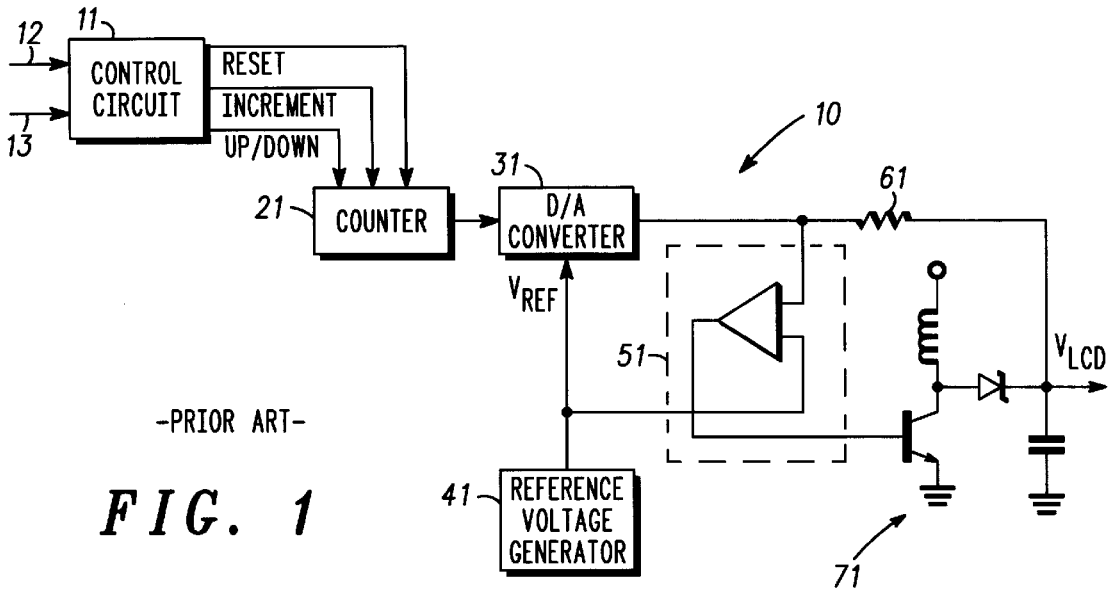
FIG. 1 shows a block diagram of a prior art digitally controlled circuit for producing LCD contrast voltage signal.

Referring to FIG. 1, a prior art digitally controlled circuit 10 for producing LCD contrast voltage consists of a logic control circuit 11, a 6-bit counter 21, a 6-bit current-output DAC 31 (which is of the current steering type), a reference voltage generator circuit 41, a switching-mode power supply (SMPS) 51, a resistor 61, and a base driver circuitry 71.

The logic control circuit 11 receives two control signals from a MCU (not shown): VLCDCON 12 and VLCDADJ 13.

VLCDCON 12 is for enabling counting functions, and VLCDADJ 13 is for clock adjustments. The logic circuit 11 generates control signals (increment/decrement, up/down, reset, clear, latch) to the 6-bit counter 21. Whenever counter 21 reaches a pre-set digital value, it generates a latch signal to the 6-bit DAC 31. Operating with reference voltage generator 41, DAC 31 will then converts the digital counter value to an equivalent analog current value (I_DAC). This current will cause an IR drop across the feedback resistor 61, which is located between the LCD contrast voltage output (VLCD) and the feedback voltage (VFB) input to the SMPS 51. The VFB voltage is determined by VLCD minus the IR voltage drop across the feedback resistor 61. In order to maintain the feedback voltage VFB to be equal to the reference voltage (VREF), SMPS 51 generates a base drive voltage, in closed-loop operation, to recharge the base driver circuitry 71 whenever VLCD drops below a pre-set value.

It will be understood that the feedback resistor 61 is usually an external device. It will be understood that the output contrast voltage signal is affected by a temperature variation, dependent on the temperature coefficient of the external resistor, and the DAC output current.

It will be further understood that in the prior art circuit of FIG. 1, the DAC and the reference voltage block consume most of the quiescent power (in the range of 10–100 $\mu$A of current).

A disadvantage of this digitally controlled circuit is that it consumes a relatively high quiescent current. Such a high quiescent current can significantly shorten battery life in a battery operated system.

Figure 2:
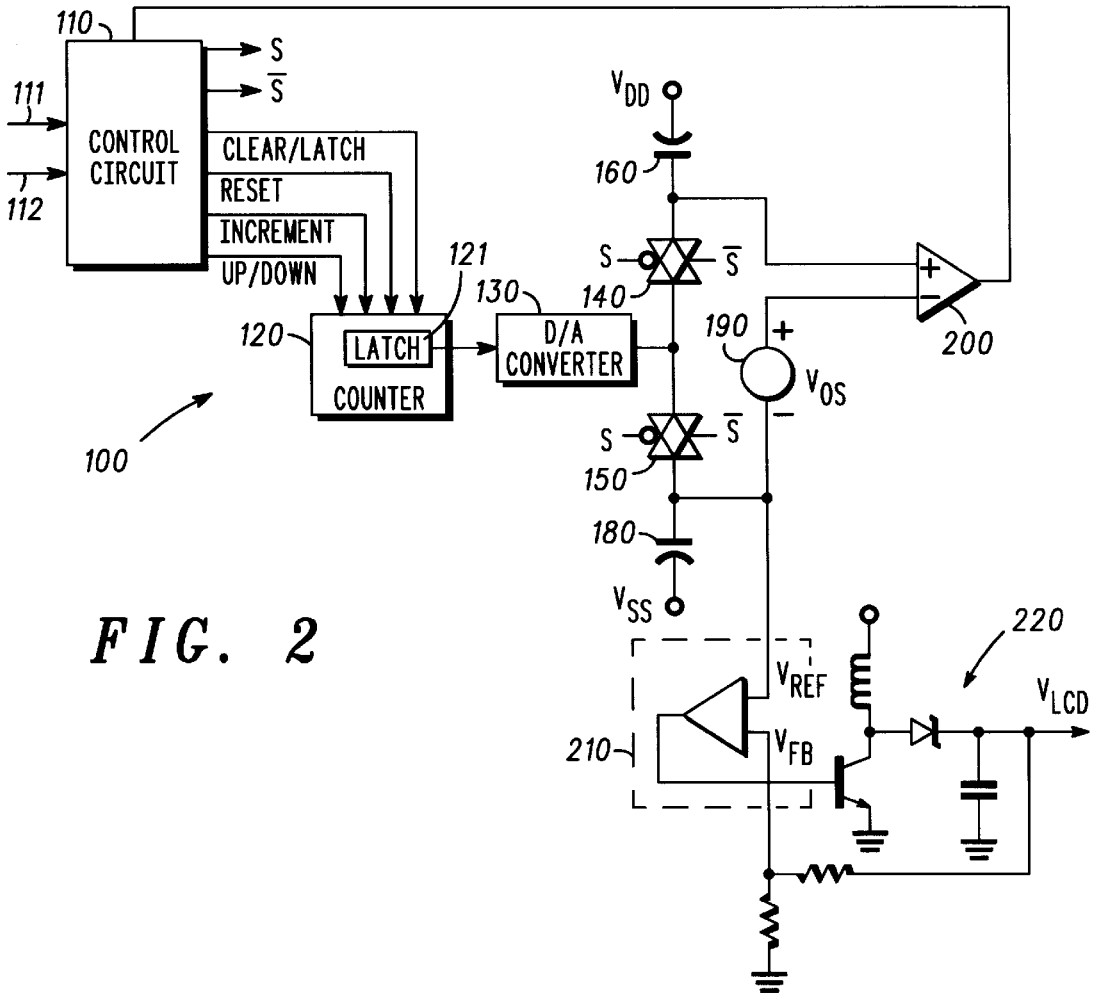
FIG. 2 shows a novel, MCU-controlled, low power circuit for producing a contrast voltage signal for a liquid crystal display.

FIG. 2 illustrates a novel, digitally controlled, low power (low quiescent current) circuit 100 for producing a contrast voltage signal for an LCD. This circuit 100 consists of a logic control circuit 110, a 6-bit counter 120 with latch 121, and a 6-bit R2R ladder network DAC 130 connected serially together. The output of the 6-bit DAC 130 is connected back-to-back to two transmission gates 140 & 150. The control signals to the transmission gates are provided by the logic control circuit 110. The transmission gate 140 is connected via a charge capacitor 160 to a datum voltage Vdd. The transmission gate 150 is connected via a charge capacitor 180 to a datum voltage Vss. The charge capacitor 160 is connected (at its electrode adjacent the transmission gate 140) to the positive input of a voltage comparator 200. The charge capacitor 180 is connected (at its electrode adjacent the transmission gate 150) to a reference voltage input VREF of a SMPS 210. The charge capacitor 180 (at its electrode adjacent the transmission gate 150) is also connected via an offset voltage source 190 to the negative input of the voltage comparator 200. The output of the comparator 200 is connected to provide a feedback path to the logic control circuit 110.

In use, the logic control circuit 110 receives two control signals from an MCU (not shown): VLCDCON 111 & VLCDADJ 112. VLCDCON 111 is for enabling counting functions, and VLCDADJ 112 is for clock adjustments. As will be discussed further below, the logic control circuit 110 also receive a refresh signal from the voltage comparator 200.

The circuit 100 operates in three cycles (ACQUIRE, EXECUTE and IDLE) as follows.

In the ACQUIRE cycle, the logic control circuit 110 generates clock operation commands to the 6-bit counter 120, and generates control signals to the transmission gates 140 and 150.

In the EXECUTE cycle, the counter 120 content is latched (in the counter latch 121) to the DAC 130, and the transmission gates 140 and 150 are turned on. This enables the charge capacitors 160 & 180 to be charged to VREF within a pre-set time, usually about 5 $\mu$S. Then, both the transmission gates are turned off, and the DAC input is cleared. The system begins the IDLE cycle.

In the IDLE cycle, operating in closed-loop mode, the SMPS 210 regulates output contrast voltage VLCD through base driver circuitry 220.

During the IDLE cycle, the R2R DAC 130 input is set to zero so that it consumes zero current, and the capacitor is fully charged to VREF voltage. As the capacitors 160 & 180 leak, their voltages accordingly discharge to Vdd and Vss respectively. The voltage comparator 200 monitors the discharge by comparing the voltage difference between the two capacitors 160 & 180. When the voltage difference reaches a pre-set value, the comparator 200 sends a refresh signal to logic circuit 110 to start another EXECUTE cycle.

A VLCD feedback path for the SMPS 210 is accomplished by connecting the VLCD output to the SMPS's voltage feedback input VFB through an external resistor.

It will be appreciated that in the novel circuit of FIG. 2, only the voltage comparator 200 consumes significant quiescent current, and that the voltage comparator's quiescent current is substantially less than the quiescent current consumed in the prior art circuit of FIG. 1. Tests have shown that quiescent current consumption in the circuit of FIG. 2 is less than 1 $\mu$A.

What is claimed is:

1. A circuit for producing a contrast voltage signal for a liquid crystal display, the circuit comprising:

logic control means for receiving control signals; and counter means for receiving signals from the logic control means and for counting in response thereto;

digital-to-analog converter means for receiving a count value from the counter means and for producing an analog voltage representative of the count value;

voltage storing means for storing the analog voltage from the digital-to-analog converter means;

voltage sensing means coupled to the voltage storing means for sensing when the voltage on the voltage storing means reaches a predetermined value and for producing in response thereto a refresh signal for application to the logic control means; and driver means having an input coupled to the voltage storing means for producing the contrast voltage signal.

2. A circuit as claimed in claim 1 wherein the digital-to-analog converter means is a R2R digital-to-analog converter.

3. A circuit as claimed in claim 1 wherein the voltage storing means comprises:

a first capacitor and a first transmission gate for controlling the charging of the first capacitor;

a second capacitor and a second transmission gate for controlling the charging of the second capacitor;

and wherein the voltage sensing means comprises a differential comparator having first and second inputs for receiving the voltages on the first and second capacitors.

4. A circuit as claimed in claim 3 further comprising offset voltage means coupled to one of the inputs of the differential comparator.

5. A circuit as claimed in claim 1 wherein the counter means comprises latch means.

6. A circuit as claimed in claim 1 wherein the driver means comprises switch mode power supply means having its reference voltage input coupled to the voltage storing means.

* * * * *